US005898379A

United States Patent [19]

Vanbergeijk

[11] Patent Number: 5,898,379

[45] Date of Patent: Apr. 27, 1999

[54] WIRELESS CYCLE MONITORING SYSTEM FOR POWER TOOLS

[75] Inventor: Ernst Vanbergeijk, Dearborn, Mich.

[73] Assignee: Ford Global Technologies, Inc., Dearborn, Mich.

[21] Appl. No.: 08/998,752

[22] Filed: Dec. 29, 1997

[51] Int. Cl.[6] ..... G08B 21/00

[52] U.S. Cl. ..... 340/680; 340/539; 340/447; 81/53.2; 81/470

[58] Field of Search ..... 340/680, 679, 340/539, 447, 445; 81/53.2, 470, 57.44; 73/146.4, 146.5; 417/86, 151; 152/151

[56] References Cited

U.S. PATENT DOCUMENTS

| | | | |
|---|---|---|---|
| 4,237,454 | 12/1980 | Meyer | 340/682 |
| 4,294,110 | 10/1981 | Whitehouse | 340/680 X |
| 4,464,651 | 8/1984 | Duhame | 340/521 |
| 4,639,996 | 2/1987 | Fullmer | 81/470 |
| 4,694,273 | 9/1987 | Franchino | 340/447 |
| 5,113,949 | 5/1992 | Ohdubo et al. | 173/177 |
| 5,129,465 | 7/1992 | Rahm | 81/470 |
| 5,404,833 | 4/1995 | Kleppe | 116/137 |
| 5,592,396 | 1/1997 | Tambini et al. | 364/510 |

OTHER PUBLICATIONS

Specification Sheet No. 996–C–65, Stanley Air Tools, A40 Series Angle Nutsetters With Electronically Controlled Shut–Off, 18–33 Ft.Lbs. (24–45 Nm).

Specification Sheet No. 996–C–66, Stanley Air Tools, A40 Series Angle Nutsetters With Electronically Controlled Shut–Off, 14–40 Ft.Lbs. (19–54 Nm).

*Primary Examiner*—Daniel J. Wu
*Assistant Examiner*—Anh La
*Attorney, Agent, or Firm*—Damian Porcari; Roger L. May

[57] ABSTRACT

A pneumatic tool having a radio frequency transmitting monitor as part of a system for monitoring operation of the pneumatic tool is disclosed. A pneumatic pressure valve including a sensor that generates a signal in response to sensing a predetermined condition occurring in the cycle of the pneumatic tool. The sensor provides an input to a transmitter integrated circuit that generates a radio frequency signal. A remote radio frequency receiver receives the signal and upon receipt of the radio frequency signal a processor manifests receipt of the signal and records or generates an output indicating that the predetermined condition has occurred.

11 Claims, 4 Drawing Sheets

Fig. 4
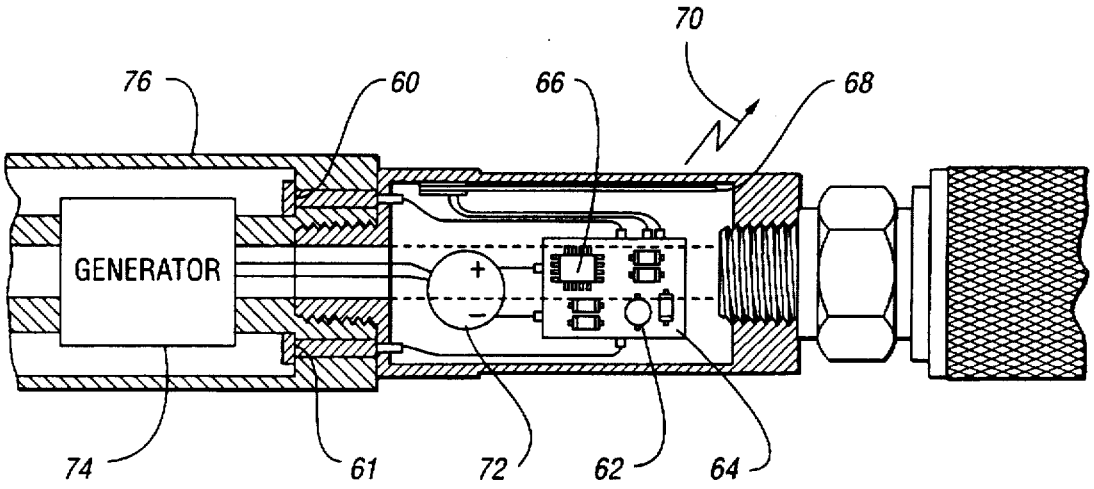
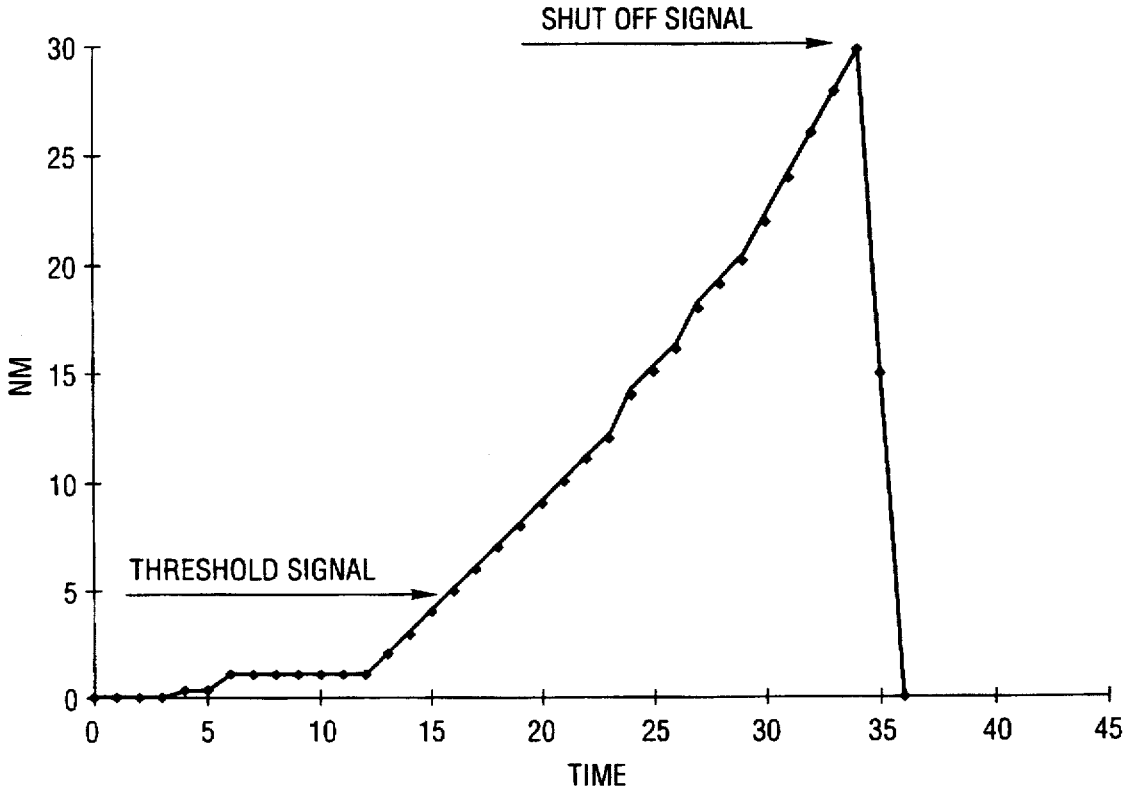
Fig. 5

WIRELESS CYCLE MONITORING SYSTEM FOR POWER TOOLS

TECHNICAL FIELD

The present invention relates to a system for monitoring operation of a power tool through a radio frequency link between a transmitter disposed on the power tool and a remote receiver.

BACKGROUND OF THE INVENTION

Pneumatic power tools are commonly used in factories due to their durability and dependability. Examples of such power tools include nut runners and screw drivers used to tighten threaded fasteners.

There has long been a need for a dependable system to validate fastener tightening on pneumatic tools without adding wires to the air supply hose. One of the advantages of pneumatic tools is that they require only a simple connection to an air line to be operational. There is no need to provide electrical connections that may be interrupted if wires break or connectors become loose or corroded. If wires are inserted either inside an air supply hose or are attached to the outside of the air supply hose, the simplicity of the pneumatic tool is compromised. Adding wires to an air hose reduces flexibility and increases the complexity of setting up the tool for operation.

In the prior art, electronic strain gauges have been hardwired to either pneumatic or electric tools in an attempt to provide fastener tightening validation. Generally strain gauges are used to measure dynamic torque. Such strain gauges are calibrated in a laboratory and can provide an alarm if the strain gauge is not within preset strain measurement limits. This type of system is not easily adapted to pneumatic tools due to the above-noted problems associated with running a wire to the strain gauge. Electronically monitoring operation of a pneumatic tool compromises the objectives of simplicity and durability and unreasonably adds to the cost of such systems and the cost of tool operation.

It has been found that complicated or unreliable electronic systems added to pneumatic tools may be disconnected or overridden. For a system to be utilized it should be automatic and must not complicate or unduly interfere with use of pneumatic tools in production.

One example of a prior art system for monitoring and controlling fluid-driven tools is disclosed in U.S. Pat. No. 5,592,396. The '396 patent discloses a flow sensor that is connected by wires through a preamplifier to a data collection computer. The flow sensor or flow meter disclosed in the '396 patent is a Venturi-type differential pressure flow meter that is coupled with a semiconductor pressure sensor transducer. This system is inaccurate because it relies upon the measurement of pressure. This system also suffers from the disadvantages noted above relating to adding wires to pneumatic tools.

These and other problems encountered by prior art monitoring systems for pneumatic tools are addressed by the wireless monitoring system for pneumatic tools of the present invention.

SUMMARY OF THE INVENTION

According to the present invention, a system for monitoring the operation of a pneumatic tool is provided. The pneumatic power tool operates through a predetermined cycle in the course of performing an operation. A sensor generates a first signal in response to a predetermined condition occurring during the operating cycle of the power tool. A control circuit is connected to the sensor to receive the first signal from the sensor and generate a second signal. A radio frequency transmitter generates a radio frequency signal in response to receiving the second signal from the control circuit. A remote radio frequency receiver receives the radio frequency signal from the transmitter and generates a signal to a processor that manifests receipt of the signal from the receiver representing that the predetermined condition has occurred.

According to another aspect of the invention, the pneumatic power tool may be either a nut runner or screw driver. The pneumatic power tool preferably has an operating cycle including a threshold torque corresponding to torque level experienced when the power tool is used to tighten the fastener. The operating cycle also includes a completion torque that may be defined as a sensed pressure or clutch control corresponding to the torque level that the tool is shut off at when the fastener circle is complete.

According to the invention, the radio frequency signal is preferably a digital signal comprising a bit stream that may be encoded to provide information to a computer. The computer preferably stores information recording tool operation cycles. The computer may be used to monitor complete cycles, incomplete cycles or all cycles. If incomplete cycles are encountered, the computer is preferably adapted to produce either an audible or visual alarm.

The radio transmitter is preferably housed within an internal cavity of a pneumatic tool. The radio transmitter may be battery powered. The system may be designed to transmit only on a cycle incomplete basis to conserve battery power. A cycle complete validation system may monitor tool operation by transmitting a pressure threshold signal and a cycle complete signal for each cycle. In a cycle complete system an on-board power generation system may be used in place of or in conjunction with a battery. An appropriate on-board power generation system may be a pneumatic source generator utilizing air flow through the tool to generate power for operation of the transmitter or recharging the transmitter battery.

The wireless communication link between the pneumatic tool and a stationary receiver can be used to keep records of both the cycle complete and cycle incomplete signals that are sent from the tool to the central receiver. The computer system may be programmed to correlate vehicle identification numbers of vehicles manufactured on an assembly line with cycle incomplete messages to initiate repair operations and assure that assembly operations achieve quality objectives. The computer system may also provide fastener validation data to the vehicle manufacturing record to provide quality assurance records for the manufacturing process.

These and other objects and advantages of the present invention will be better understood in view of the attached drawings and following detailed description of the invention.

BRIEF DESCRIPTION OF THE DRAWINGS

FIG. 4 is a fragmentary cross-sectional view of a monitoring module having an on-board power generation system comprising a pneumatic source generator.

FIG. 5 is a chart showing torque over time representing a successful tool operating cycle.

DETAILED DESCRIPTION

Figure 1:
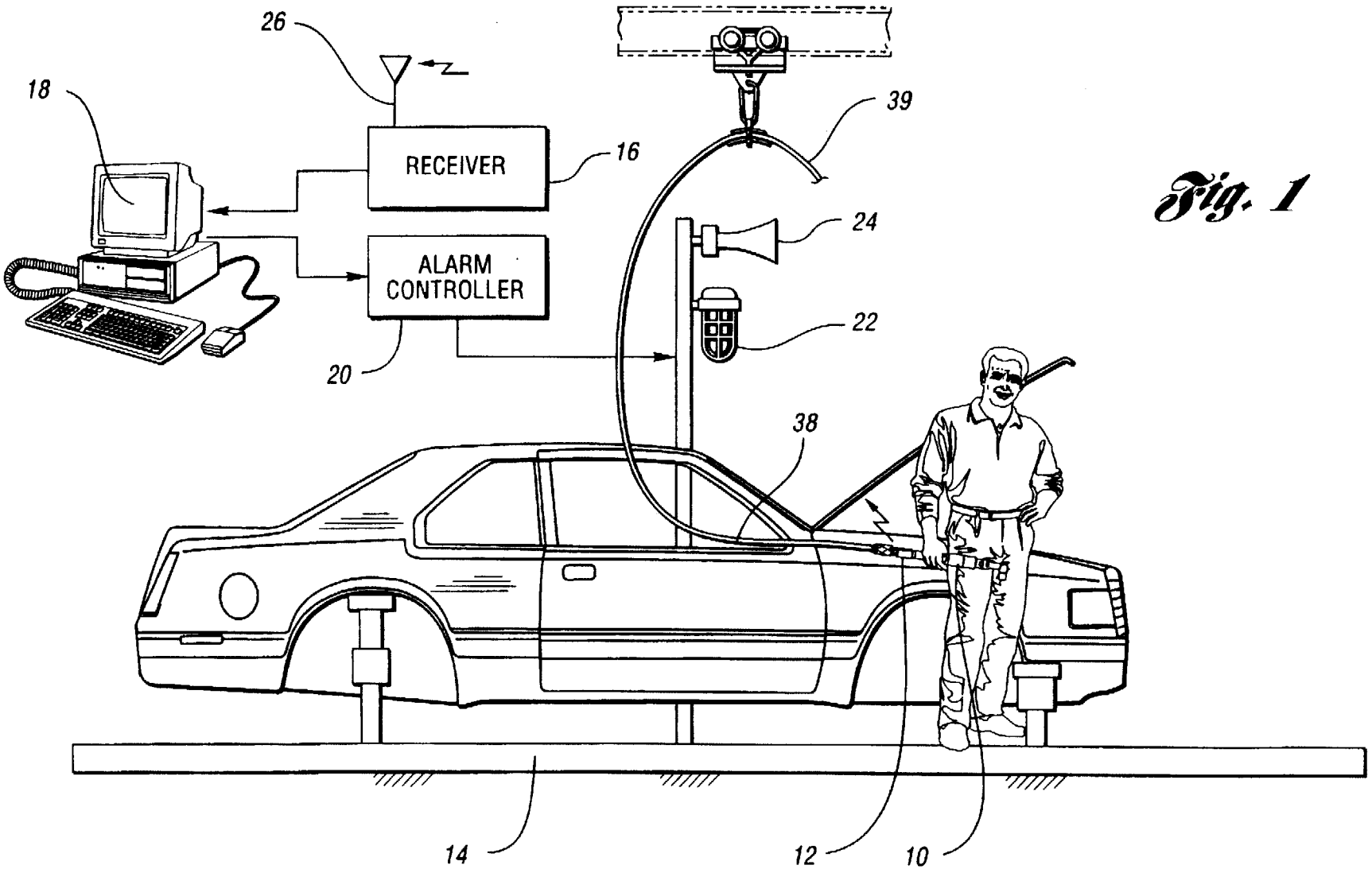
FIG. 1 is a side elevation view of an assembly line station with the monitoring system of the present invention depicted partially diagrammatically.

Referring now to FIG. 1, a pneumatic tool 10, including an RF transmitting monitor 12 is shown ready for use at an assembly line station 14. An RF receiver 16 tuned to the same frequency of the RF transmitting monitor 12 provides an input to a computer 18. The frequency is 433.92 MHz in accordance with FCC requirements. Computer 18 communicates with an alarm controller 20 that is operative to actuate a visual alarm 22 and/or an audible alarm 24 if an operating cycle of the pneumatic tool 10 does not meet the required thresholds for fastener tightening required to meet the predetermined torque limit standards. The computer 18 is preferably a microprocessor capable of logging and displaying data. Also shown diagrammatically on FIG. 1 is a receiver antenna 26 that is connected to the receiver 16.

Figure 2:
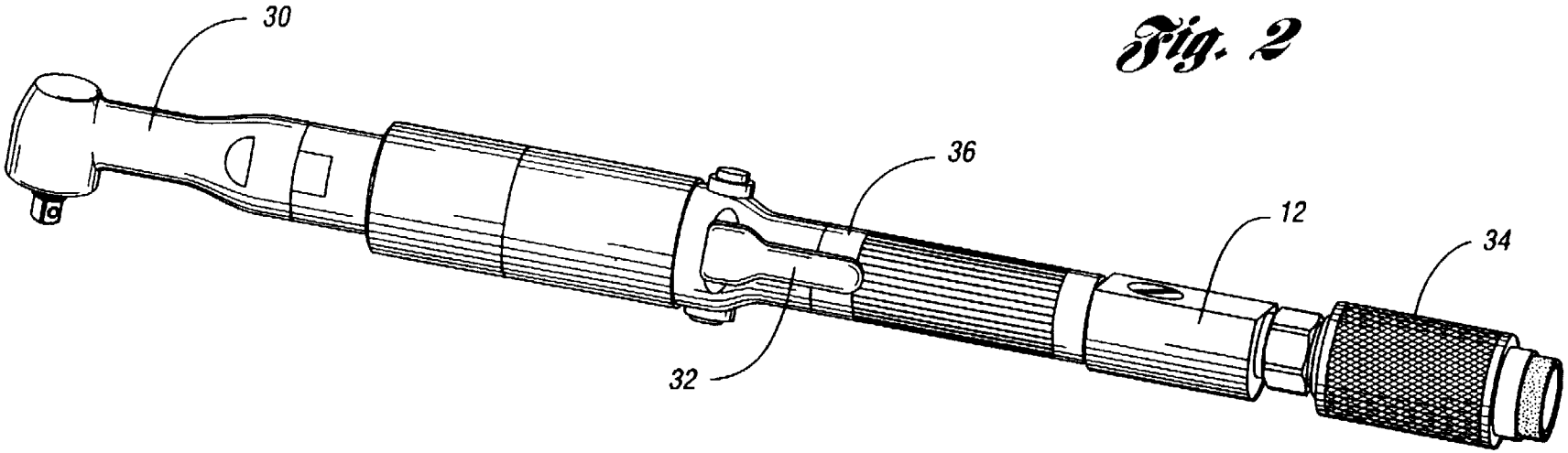
FIG. 2 is a perspective view of a pneumatic tool incorporating a monitoring module including a transmitter.

Referring now to FIG. 2, nut runner 30 having the RF transmitting monitor 12 of the present invention is shown. The tool 30 has a trigger 32 that is used to operate the tool 30. A hose connector 34 is shown connected to the RF transmitting monitor 12. A handle/valve body 36 is connected to the RF transmitting monitor 12. The tool 30 is generally held by the handle/valve body 36 and operated by squeezing the trigger 32. Compressed air is provided via the hose connector 34. As shown in FIG. 1, compressed air is supplied through a hose 38 from a compressed air source 39.

Figure 3:
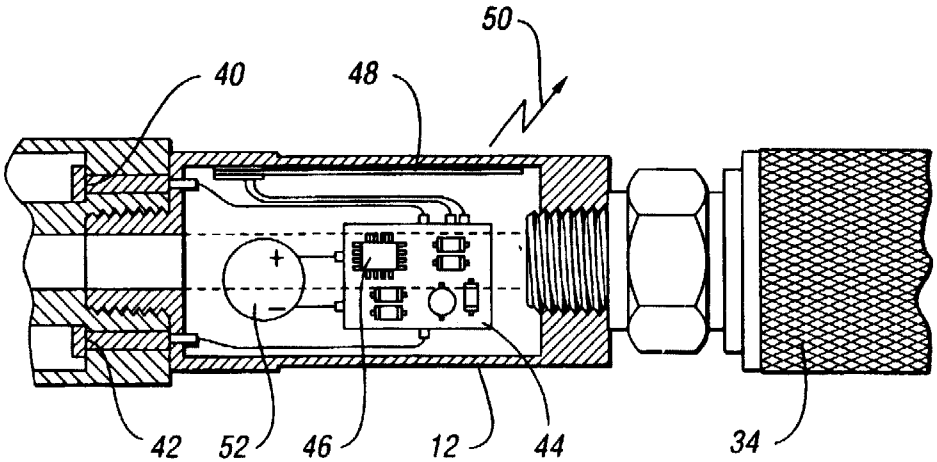
FIG. 3 is a fragmentary cross-sectional view of monitoring module made in accordance with the present invention.

Referring now to FIG. 3, the RF transmitting monitor 12 is shown in greater detail. The illustrated monitor includes first and second pressure switch sensors 40 and 42 that are preferably pneumatic pressure valves. Alternatively, the sensors 40 and 42 may be switch contacts connected to shifting mechanical valve components, such as a spool valve, housed in the handle/valve body 36 that open and close in response to movement of the valve components.

For example, movement of a spool valve to its "off" position opens a part to direct line pressure to the shutoff signal port indicating that the tool has completed its cycle. This signal remains on until the operator releases the throttle. An adjustable spring based poppet valve opens a port at a threshold torque to indicate that torque has begun to rise as the fastener cycle starts. This threshold and shutoff signal are converted to electrical signals by pressure actuated contact closures.

The tool may alternatively be a clutch actuated tool. If so, torque transmitted through a release of the clutch will release a push rod to allow a poppet valve to close the valve. Pressure may be sensed above and below the shutoff valve with the pressure differential across the valve generating a "shutoff" signal.

A circuit board 44 is provided in the transmitting monitor 12 and includes an appropriate circuit for operating an integrated circuit for a transmitter 46 in response to signals from either of the first and second transducers. A digital radio frequency signal 50 is transmitted by transmitter antenna 48. The broadcast signal is preferably a 9 bit data stream with 5 bits dedicated to tool address and 4 bits being available to use for status conditions such as low battery, cycle start or cycle complete. The radio frequency signal 50 is shown diagrammatically in FIG. 3 and is received at the receiver antenna 26 shown in FIG. 1. In the embodiment shown in FIG. 3, a battery 52 provides power for radio frequency transmitting monitor 12. The battery is preferably a 3 volt lithium battery with a 300 milliamp hour life.

Referring now to FIG. 4, first and second sensors 60 and 61 produce inputs that are received by the circuit 62 on the circuit board 64 of an integrated circuit transmitter 66. The integrated circuit transmitter 66 generates digital radio frequency signals to a transmitter antenna 68 that in turn, emits a radio frequency signal 70. A battery 72 stores power for the circuit 62 and is recharged by a pneumatic source generator 74 that is housed within the handle/valve body 76.

Referring now to FIG. 5, a successful fastening cycle is shown in which a fastener is tightened to a specified torque level. A threshold signal is received from a first sensor 40 indicating that the wrench 30 has engaged the fastener and the torque has exceeded the threshold signal. The tightening cycle continues until the tool reaches the desired torque level. The second sensor 42 indicates that the predetermined torque has been reached. The tool is shut off and the second sensor 42 sends a signal to the transmitter IC communicating through the RF signal that a successful tool operation has occurred.

If the system is a validation system wherein record of successful tool cycle is recorded by the computer, the successful fastening cycle is logged and may be correlated to the vehicle identification number in the vehicle manufacturing record. If the system is operated in a cycle incomplete mode no signal would be transmitted by the transmitter on either reaching the threshold signal or the cycle complete level to conserve battery power.

Figure 6:
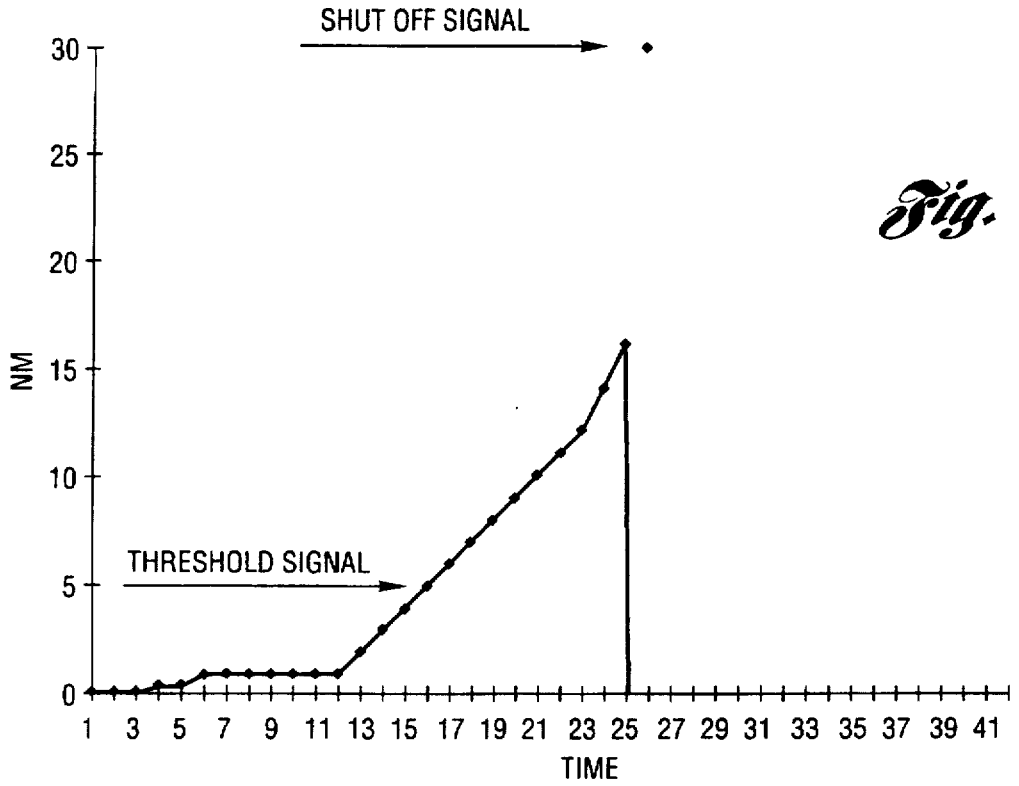
FIG. 6 is a chart showing torque over time of representing unsuccessful tool operating cycle.

Referring now to FIG. 6, an incomplete fastening cycle is shown wherein the threshold signal has been exceeded but the fastener does not reach the level of torque desired. In a cycle incomplete by the transmitter transmits a cycle incomplete signal that is interpreted by the computer and may be used to actuate the visual or audible alarms.

Figure 7:
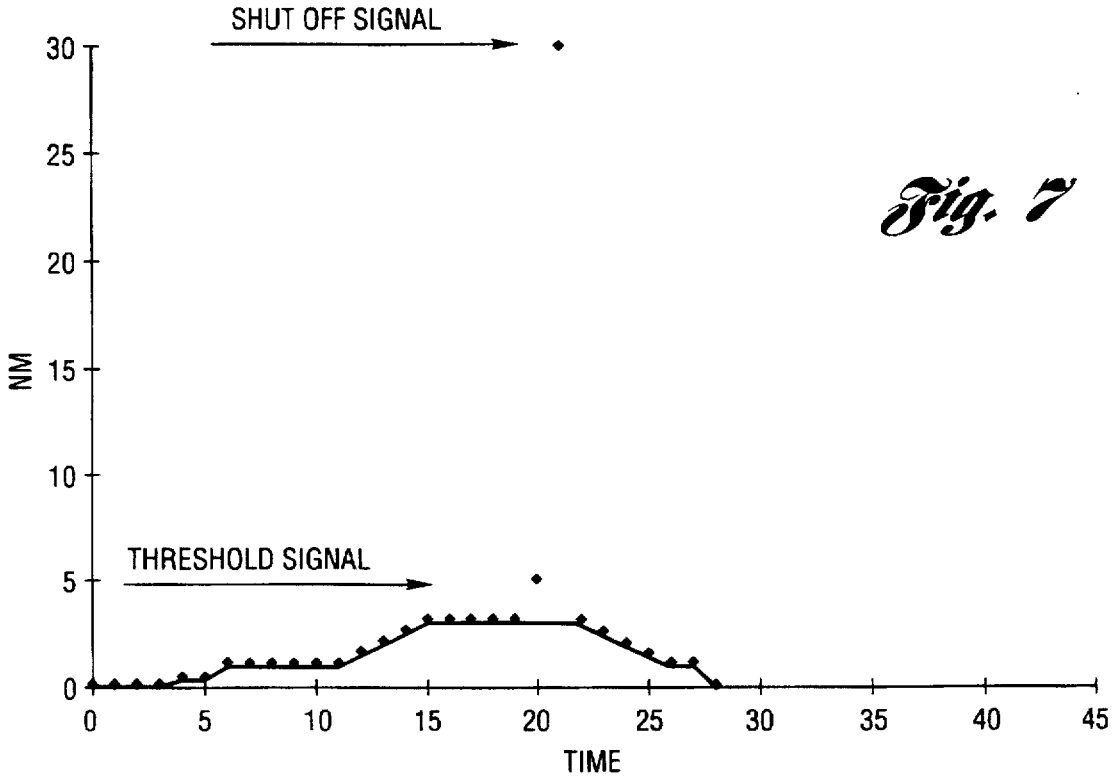
FIG. 7 is a chart showing torque over time representing a non-cycle in which the threshold torque level is not reached.

Referring now to FIG. 7, a false cycle is illustrated wherein the operator inadvertently touches the trigger or runs the tool without engaging a fastener to check its operation. In this instance, the first sensor 40 is not actuated and the tool does not begin the timing cycle and the cycle incomplete signal is not transmitted. In this way false alarms that may otherwise be caused by free running the tool are not registered.

The handle/valve body 36 may have space to accommodate the transmitting monitor 12. A plastic handle is preferred if the antenna is located within the handle 36.

The above-described embodiments of the invention are provided as examples and should not be read in a limiting sense. The broad scope of the invention should be construed in accordance with the following claims.

What is claimed is:

1. A system for monitoring the operation of a tool comprising:

a pneumatic power tool having a cycle that it operates through in performing an operation;

first and second independent sensors, said first sensor generates a first signal in response to exceeding a threshold torque level occurring during the cycle of the power tool;

a control circuit connected to the sensor receives the first signal and generates a second signal;

a radio frequency transmitter generates a third signal in response to receiving the second signal from the control circuit;

a remote radio frequency receiver receives the third signal from the transmitter and generates a fourth signal;

a processor receives the fourth signal and manifests the receipt of the fourth signal representing that the threshold torque has been exceeded;

the cycle continues until said second sensor generates a fifth signal in response to exceeding the completion torque level. the fifth signal is used to shut off the tool and is also provided to the control circuit that generates a sixth signal;

the radio frequency transmitter generates a seventh signal in response to receiving the sixth signal;

the remote radio frequency receives the seventh signal from the transmitter and generates an eighth signal; and the processor receives the eighth signal and manifests the receipt of the eighth signal representing the successful completion of a tool cycle.

2. The system of claim 1 wherein the power tool is a nut runner.

3. The system of claim 2 wherein the nut runner has an operating cycle including a threshold torque corresponding to torque levels encountered when the nut runner is used to tighten a fastener.

4. The system of claim 2 wherein the first and second sensors are pneumatic pressure valves.

5. The system of claim 1 wherein third signal and sixth signal are digital signals.

6. The system of claim 1 wherein the processor is a computer that upon receipt of the eighth signal stores information recording that the tool operated through the complete cycle to a completion torque.

7. The system of claim 1 wherein the processor is a computer that stores information recording that the tool failed to operate through the cycle to a completion torque only after the processor receives the fourth signal representing that the threshold torque has been exceeded.

8. The system of claim 7 wherein the computer generates a signal to an alarm circuit that produces an audible alarm.

9. The system of claim 7 wherein the computer generates a signal to an alarm circuit that produces a visually observable alarm.

10. The system of claim 1 wherein the control circuit is powered by a battery.

11. The system of claim 1 wherein the control circuit is powered by a battery that stores power for the control circuit and is recharged by a pneumatic generator that is housed within the pneumatic power tool.

* * * * *